US005146629A

United States Patent [19]

Barnes

[11] Patent Number: 5,146,629

[45] Date of Patent: Sep. 15, 1992

[54] RINSE SHIELD

[76] Inventor: Monica L. Barnes, 108 N.W. St. Helens Pl., Bend, Oreg. 97701

[21] Appl. No.: 741,316

[22] Filed: Aug. 7, 1991

[51] Int. Cl.[5] ..... A45D 44/00

[52] U.S. Cl. ..... 2/174; 4/521; 2/50

[58] Field of Search ..... 2/50, 174; 4/521; 132/270

[56] References Cited

U.S. PATENT DOCUMENTS

| | | | |
|---|---|---|---|
| 717,148 | 12/1902 | Walters | 4/521 |
| 772,763 | 10/1904 | Walters | 4/521 |
| 835,814 | 11/1906 | Dalton | 2/50 |
| 981,588 | 1/1911 | Nelson | 4/521 |
| 986,728 | 3/1911 | Lee | 4/521 |
| 1,283,357 | 10/1918 | Thompson | 2/174 |
| 1,283,358 | 10/1918 | Thompson | 2/174 |
| 1,593,042 | 7/1926 | Streuli | 2/174 |
| 1,806,155 | 5/1931 | Farrelly | 4/521 |
| 2,087,843 | 7/1937 | Goodrich | 4/521 |
| 2,136,039 | 11/1938 | Clancy | 4/521 |
| 2,226,956 | 12/1940 | Womack | 2/174 |
| 2,296,078 | 9/1942 | Young | 2/174 |
| 2,301,486 | 11/1942 | Weilerstein | 4/521 |
| 2,323,515 | 7/1943 | Cary | 2/174 |
| 2,327,678 | 8/1943 | Stovall | 2/174 |
| 2,413,456 | 12/1946 | Larkin | 4/521 |
| 2,424,744 | 7/1947 | Dicken | 2/174 |
| 2,447,215 | 8/1948 | Stovall | 2/174 |
| 2,447,776 | 8/1948 | Sherwood | 2/174 |
| 2,547,810 | 4/1951 | Burgess | 4/521 |
| 2,599,152 | 6/1952 | Barttay | 2/174 |
| 2,600,392 | 6/1952 | Cancell | 4/521 |
| 2,684,072 | 7/1954 | Lewis | 4/521 |
| 2,791,778 | 5/1957 | Wardley | 2/174 |
| 3,235,882 | 2/1966 | Coleman | 2/174 |
| 3,319,262 | 5/1967 | Lee | 4/521 |
| 4,014,054 | 3/1977 | Pasquarello | 4/521 |
| 4,605,017 | 8/1986 | Thompson | 2/174 |
| 4,611,354 | 9/1986 | Jones | 2/174 |

FOREIGN PATENT DOCUMENTS

| | | | |
|---|---|---|---|
| 713335 | 10/1931 | France | 4/521 |
| 825399 | 3/1938 | France | 4/521 |
| 370131 | 4/1932 | United Kingdom | 2/50 |
| 689704 | 4/1953 | United Kingdom | 2/174 |

*Primary Examiner*—Werner H. Schroeder
*Assistant Examiner*—Diana L. Biefeld
*Attorney, Agent, or Firm*—Klarquist, Sparkman, Campbell, Leigh & Whinston

[57] ABSTRACT

Rinse shields are disclosed that are adapted to be worn by a person while the person's hair is being washed, rinsed, or otherwise treated with a liquid and while the person's upper body is in an upright position. The rinse shields prevent the liquid from contacting the subject's body or clothing below the hairline level when the rinse shield is being worn. The various embodiments, each of which is adapted to be worn around the subject's head at about the hairline level with the subject's hair placed above the hairline level, basically comprise a front, or taut, portion and a tail portion contiguous with the front portion. The front portion defines an opening therethrough adapted to sealingly fit to the person's head at about the hairline level and is adapted to form a brim around the front and sides of the person's head. Various stiffeners may be incorporated into the front portion to facilitate forming the brim. The tail portion is adapted to drape rearwardly downward from the rear of the front portion, thereby covering at least the back of the person's neck, and into a sink or other vessel. Liquids applied to the person's hair while the person is wearing the rinse shield flow from the person's hair to the upper major surfaces of the front and tail portions into the vessel.

18 Claims, 6 Drawing Sheets

RINSE SHIELD

FIELD OF THE INVENTION

This invention pertains to protective garments adapted for preventing a wearer's face and body from becoming wet while the wearer's hair is being washed, rinsed, or otherwise treated with a substantial volume of liquid.

BACKGROUND OF THE INVENTION

When a person (herein referred to as the "subject") is having his or her hair washed, rinsed, or otherwise treated with a substantial volume of liquid at a hair-styling salon or other facility, the subject typically sits in a "shampoo chair" or similar specialized chair and assumes a rearwardly tilting posture so as to rest the subject's head face up over the rim of a shampooing sink or bowl. Thus, the subject's hair is suspended downwardly in the sink where the hair and scalp can be wetted with water or hair-treating solution while preventing other portions of the subject's body or clothing from being wetted.

The tilt-back posture of the subject can be inconvenient for the hair stylist. For example, a subject receiving a permanent-wave treatment usually must assume the tilt-back posture while the stylist is rinsing permanent-wave solution or neutralizer solution from the subject's hair which is still in rollers. When the subject is in the tilt-back posture, the back of the subject's head is facing downward in the sink. Hair rollers situated in the back of the subject's head can be very difficult for the stylist to rinse, even when using a hose with rinsing nozzle, without greatly increasing the likelihood of wetting the subject or the subject's clothing.

The tilt-back posture can also be extremely painful for some subjects and physically impossible for others, such as elderly or physically handicapped persons and persons confined to hospital beds. Even persons with normal physical abilities often experience substantial discomfort when tilting rearward over the rim of a shampoo sink while wearing permanent-wave rollers because the rollers above the back of the subject's neck tend to become pressed between the sink rim and the back of the subject's neck or scalp. The subject's discomfort can be so great that many hair stylists strive to shorten the rinse time as much as possible. Unfortunately, shortening the rinse leaves some permanent-wave solution or neutralizer solution in the subject's hair, which can cause eventual damage to the subject's hair, objectionable residual odor in the subject's hair after receiving a permanent wave, and lifting of hair color.

Subjects confined to wheelchairs or hospital beds often cannot assume a tilt-back posture or experience great pain or discomfort when attempting to do so. Consequently, these subjects often must forego certain hair treatments. However, these individuals would often greatly benefit from the boost in self esteem and sense of well-being that accompany having the hair styled or permed.

Therefore, there is a need for an appliance wearable by a subject to permit washing, treating, and rinsing the subject's hair without the subject having to assume a tilt-back posture over the rim of a shampooing sink or bowl.

There is also a need for such an appliance that permits washing, treating, and rinsing the subject's hair while the subject's upper body is in an upright position, such as when sitting upright in a hair-styling chair.

There is also a need for such an appliance that permits washing, treating, and rinsing the subject's hair without wetting the subject or the subject's clothing.

There is also a need for such an appliance that is convenient for the hair stylist when washing, rinsing, or treating the subject's hair.

There is also a need for such an appliance that is comfortable for the subject to wear while having his or her hair washed, rinsed, or treated.

SUMMARY OF THE INVENTION

The present invention addresses the aforementioned needs by providing a rinse shield adapted to be worn by a person (referred to herein as the "subject") while the subject's hair is being shampooed, rinsed, and the like and the subject's upper body is in an upright position. The rinse shield is particularly suitable for use when the subject is sitting upright in a chair or even a bed.

One embodiment of a rinse shield according to the present invention basically comprises a sheetlike taut portion and a flexible sheetlike tail portion. The taut portion defines an opening therethrough adapted to sealingly fit on the subject's head at about the hairline level. When the rinse shield is worn, the subject's hair is placed above the hairline level. The taut portion forms a brim around the front and sides of the subject's head and the tail portion drapes rearwardly downward relative to the taut portion to at least cover the back of the subject's neck. The tail portion is adapted to drape into a shampoo sink or analogous vessel while the subject sits upright with the subject's back facing the vessel. Thus, the brim is adapted to prevent propagation, to areas below the brim, of drips and splashes from liquid applied to the subject's hair above the brim. I.e., the subject's clothing and body below the brim remain dry while the subject's hair is being washed, rinsed, or otherwise treated with a liquid.

Another embodiment of the rinse shield of the present invention comprises a liquid-impermeable sheet member having a front portion and a contiguous tail portion. The front portion defines an opening therethrough adapted to sealingly fit on a subject's head at about the hairline level with the tail portion draping rearwardly relative to the front portion. The opening is provided with a sealing member adapted to circumferentially contact the wearer's head at about the hairline level so as to prevent passage, when the rinse shield is worn, of liquid through the opening between the sealing member and the subject's head. The front portion is provided with a stiffener adapted to tautly draw the front portion radially outward relative to the opening, thereby forming the front portion into a taut brim while allowing the tail portion to drape relative to the front portion. The stiffener can have any of a number of embodiments such as, but not limited to, a spring wire flexed into an arcuate shape and affixed to the margin of the front portion. The sealing member can also have a number of embodiments affixed circumferentially to the opening including, but not limited to, a length of elastomeric tubing coupled end to end into a toroid or a length of elastomeric ribbon coupled end to end to form a headband. Although the brim can be planar, it preferably has an upwardly concave shape when the rinse shield is worn by the subject. The tail portion can include various attachment means such as hooks or suction cups adapted to affix the tail portion to an object such as the inside surface of a sink or a bed rail. The tail portion can also be provided with a liquid-capturing pouch to be used in lieu of a sink or the like.

DETAILED DESCRIPTION OF THE PREFERRED EMBODIMENTS

Figure 1:
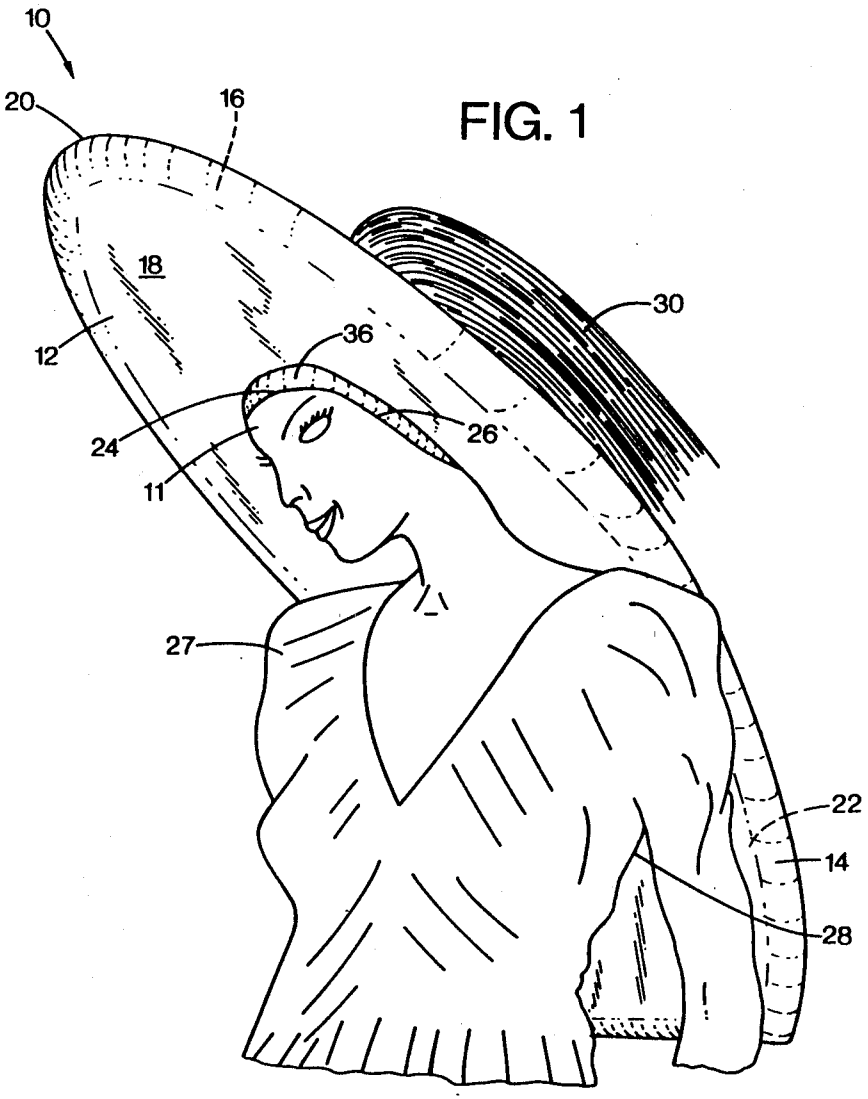
FIG. 1 depicts a rinse shield according to the present invention fitted to the head of a subject.
Figure 2:
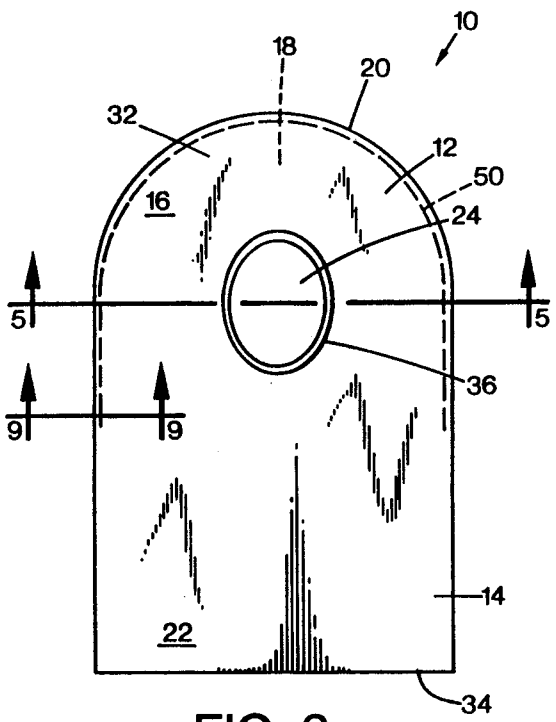
FIG. 2 is a plan view of one embodiment of a rinse shield according to the present invention, with the upper major surface thereof facing the viewer.

FIGS. 1 and 2 show one embodiment of a rinse shield 10 according to the present invention. FIG. 1 shows the FIG. 2 embodiment fitted to a subject's head 11. The rinse shield 10 comprises a front portion 12 and sheet-like tail portion 14 contiguous with the front portion 12. The front portion 12 includes an upper major surface 16, a lower major surface 18, and a front margin 20. The tail portion 14 includes an upper major surface 22 contiguous with the upper major surface 16 of the front portion 12. The front portion 12 also defines an opening 24 therethrough adapted to sealingly fit circumferentially to the subject's head 11 at about the hairline level 26.

As shown in FIG. 1, when the subject 27 is wearing the rinse shield 10, the front margin 20 of the front portion 12 is oriented forwardly relative to the subject's head 11. The front portion 12 is adapted to form a brim extending outward from the front and sides of the subject's head 11 while the tail portion 14 drapes loosely downward at least to the subject's upper back 28. It has surprisingly been found that the weight of the tail portion 14 draping downward as described helps in forming the front portion 12 into a brim. The upper major surface 16 of the front portion 12 is oriented upwardly relative to the subject's head 11. The subject's hair 30 is gathered above the hairline level and allowed to rest on the upper major surfaces 16, 22.

Figure 3A:
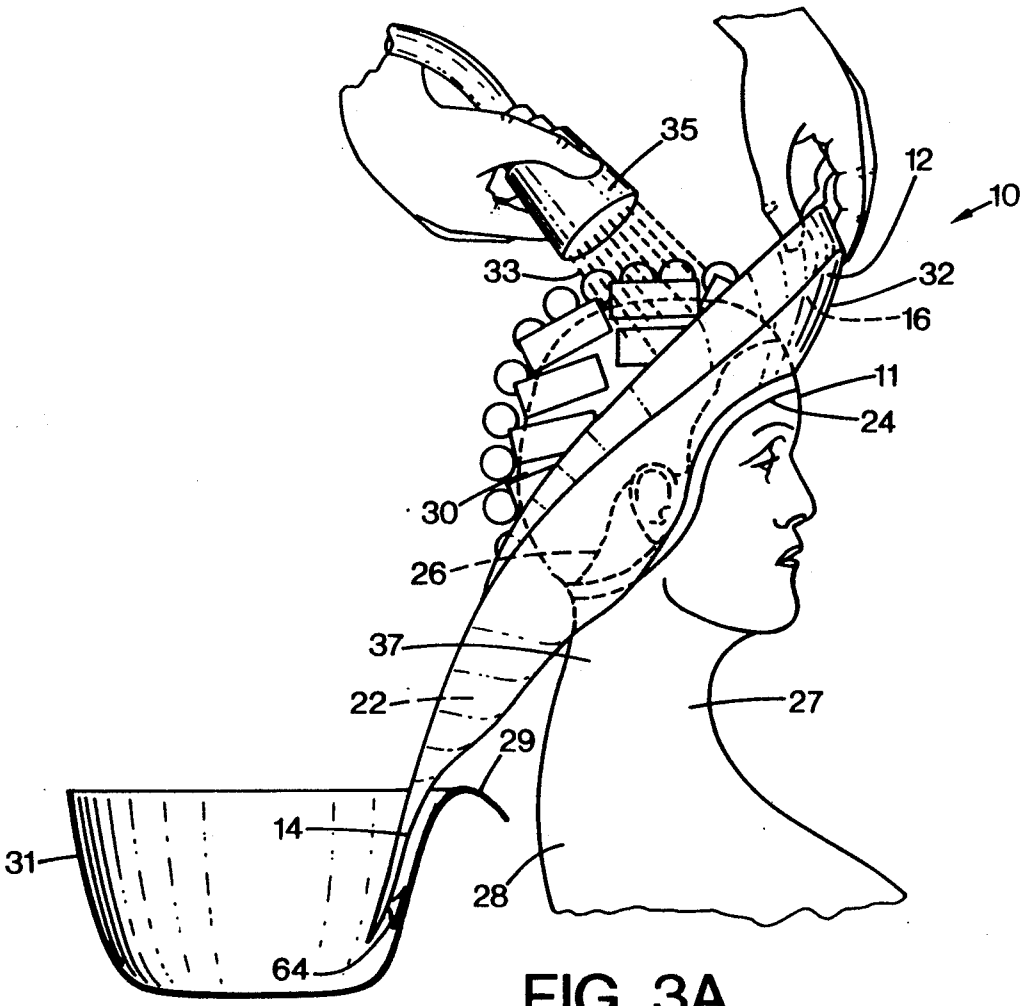
FIG. 3A is a side view of a subject sitting upright and wearing a rinse shield according to the present invention, with the subject's upper back contacting the front of a shampoo sink.

As depicted in FIG. 3A, the rinse shield 10 is worn by the subject 27 while having his or her hair 30 washed, rinsed, or otherwise treated with a liquid. The rinse shield 10 permits the subject 27 to sit upright in a "shampoo chair" (not shown) or analogous appliance which can be a wheelchair or even a bed with the subject's upper back 28 situated adjacent a rim 29 of a shampoo sink or other liquid-capturing vessel. The tail portion 14 of the rinse shield 10 drapes into the sink 31. A hair stylist washes, rinses, or otherwise applies liquid 33 to the subject's hair 30 (shown in rollers) such as by using a rinse nozzle 35. Splashes, drips, and liquid draining from the subject's hair impinge or flow onto the upper major surfaces 16,22 of the front and tail portions 12, 14, respectively. Such liquid then flows downward from the upper major surfaces 16, 22 into the sink 33. The opening 24 of the rinse shield 10 sealingly fitted to the subject's head 11 at about the hairline level 26 prevents passage of liquid applied to the hair 30 down the subject's neck 37. Thus, the subject 27 remains dry while conveniently and painlessly sitting upright during the entire time that liquids are applied to the subject's hair 30.

Figure 3B:
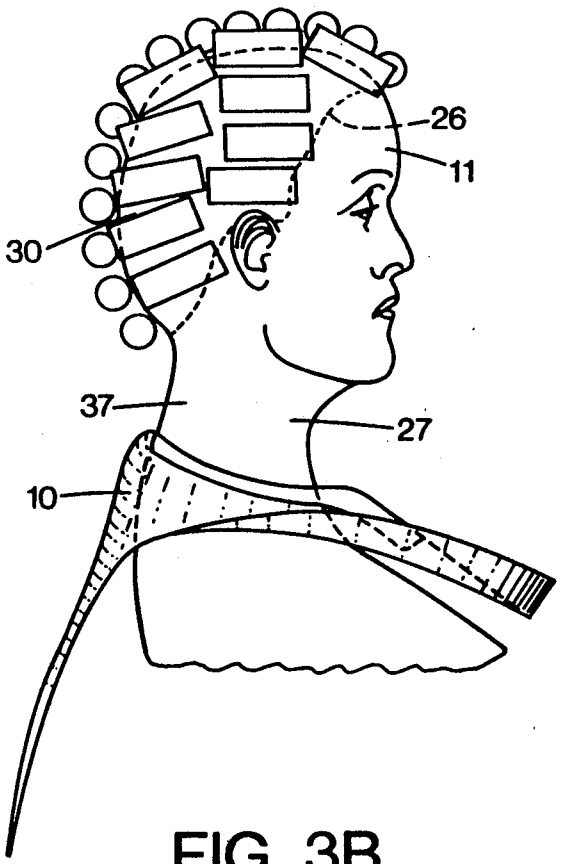
FIG. 3B is a side view of the subject of FIG. 3A with the rinse shield worn in a temporary lowered position around the subject's neck.

If desired, the rinse shield 10 can be lowered around the subject's neck 37 and shoulders whenever liquids are not being applied to the subject's hair 30, as shown in FIG. 3B. Lowering the rinse shield 10 in this manner is particularly convenient when, for example, the subject's hair is being wound onto rollers.

The rinse shield can also be worn by the subject, sitting upright at the hair-stylist's work station, while the stylist applies permanent-wave solution or neutralizer solution to the subject's hair. Thus, the subject remains dry and comfortable during application of said solutions to his or her hair.

The front portion 12 and the tail portion 14 can be constructed of any of a number of sheetlike or film materials. Such materials should be liquid-impervious. Candidate materials include, but are not limited to, any of a wide variety of plastic films and sheets, inherently liquid-impervious woven and non-woven fabrics, and fabrics that have been coated with an organic polymer or otherwise treated to render them liquid-impervious. As used herein, "liquid-impervious" denotes the property of not allowing passage therethrough of any of the various liquids or solutions that can be applied to the hair. Obviously, the material used to make the rinse shield can be of virtually any color and have virtually any color design.

The front and tail portions 12, 14 are preferably contiguous and can be constructed of the same material. Alternatively, the front portion 12 can be constructed of a relatively stiff material to facilitate forming a brim and the tail portion 14 constructed of a loosely flexible material. If the front portion 12 is excessively stiff, however, the rinse shield 10 may be difficult or impossible to fit to subjects having differently sized heads. Also, an excessively stiff material can make the rinse shield inconvenient for the hair stylist to work around, particularly without causing discomfort to the subject. If, on the other hand, the front portion 12 is constructed out of a thin, drapable material, the front portion 12 should include one or more stiffener members (described in detail hereinbelow) to ensure that the front portion 12 forms a taut brim around the wearer's head 11 when the rinse shield 10 is worn.

Figure 4:
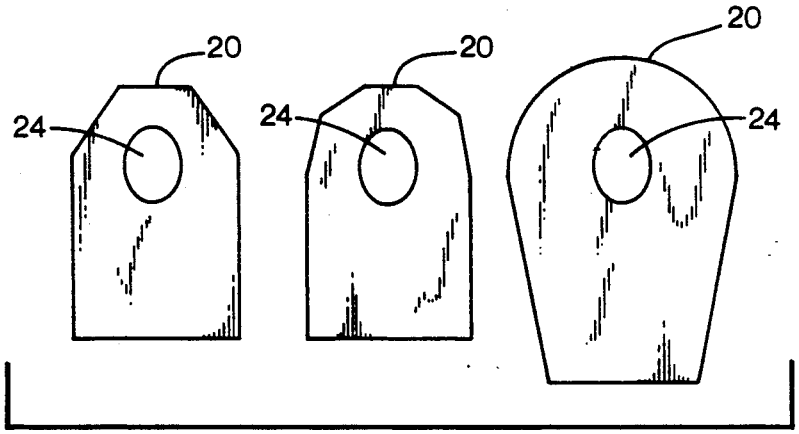
FIG. 4 shows several alternative shapes of the front margin of a rinse shield according to the present invention.

As shown in FIG. 2, the opening 24 in the front portion 12 is preferably situated in about the middle of the front portion 12 so as to form an isometric brim 32. Hence, the front margin 20 preferably has a substantially arcuate or semicircular shape. However, the front margin 20 can have any of a variety of other shapes. Examples, not intended to be in any way limiting, are shown in FIG. 4.

Referring further to FIG. 3A, when the rinse shield 10 is worn, the brim 32 should extend outwardly from the subject's head 11 a sufficient distance to prevent splashes and drips from the hair 30 to the subject's body or clothing. For example, rinse water (indicated as a liquid stream 33) is typically applied to the hair 30 using a rinsing nozzle 35, from which water can be discharged with sufficient force to cause splashing. The greater the discharge force, the greater the likelihood of splashes, the longer the distance that splashes can travel, and the wider the brim 32 should be. However, the brim 32 should not extend so far that the hair stylist is inconvenienced thereby. In general, the brim 32 should extend outward from the front of the wearer's head at least four inches and from the sides of the wearer's head at least six inches for satisfactory performance. If necessary, as shown in FIG. 3A, the hair stylist ca grasp the brim 32 while rinsing if the nozzle 35 discharges water with too great a force.

Referring further to FIG. 2, the tail portion 14 preferably has a squared end 34 to ensure adequate drape into a shampooing sink or the like. However, the end 34 can also be rounded or have any other profile, so long as the utility of the tail portion is not unduly compromised.

Referring further to FIG. 1, the tail portion 14 should be long enough to at least drape over and cover the subject's upper back 28 when the rinse shield 10 is worn, thereby providing a length sufficient to extend well into a shampooing sink or analogous vessel during use of the rinse shield (FIG. 3A).

As stated hereinabove, the opening 24 in the front portion 12 is adapted to fit circumferentially to the subject's head 11 at about the hairline level 26. The perimeter of the opening 24 is preferably provided with a sealing member 36 sealingly affixed thereto. The sealing member 36 is adapted to contact the subject's head circumferentially at about the hairline level and prevent passage of liquid through the opening when the rinse shield 10 is worn.

Figure 5A:
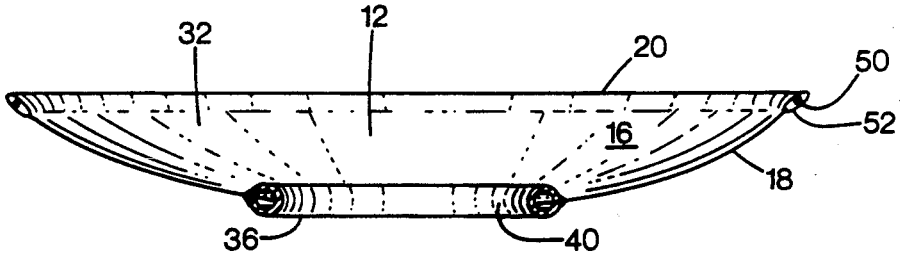
FIGS. 5A and 5B are transverse sectional views of the rinse shield of FIG. 2 showing possible alternative embodiments of the sealing member.

The sealing member 36 can have any of a variety of configurations suitable for achieving circumferential sealing engagement with the subject's head. In one embodiment, as shown in FIG. 5A, the sealing member 36 comprises a length of soft, elastomeric tubing 40 or similar material coupled end-to-end into a toroid having a circumference slightly less than the circumference of the subject's head at about the hairline level. The tubing 40 is affixed to the perimeter of the opening 24 by adhesive, heat-bonding, or other appropriate method. The rinse shield is fitted to the subject's head by stretching the circumference of the toroid slightly.

Figure 5B:
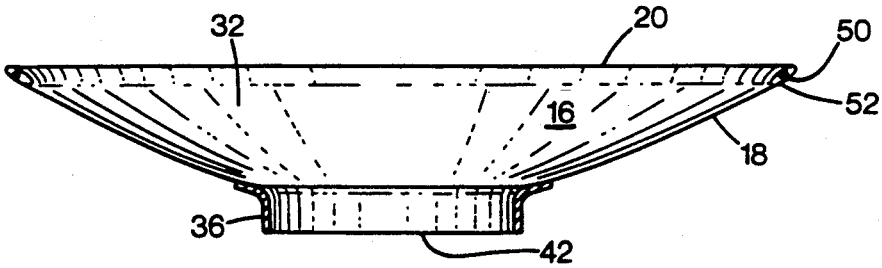

In an alternative embodiment shown in FIG. 5B, the sealing member 36 comprises a length of soft, elastomeric band, ribbon or analogous material coupled end-to-end to form a headband 42 having a circumference slightly less than the circumference of the subject's head at about the hairline level. A preferred material is a soft, elastomeric foam material about ¼-inch thick and about one inch wide. The headband 42 is affixed to the perimeter of the opening 24 by adhesive, heat-bonding, or other appropriate method. The rinse shield is fitted to the subject's head in the same manner as described above.

In yet another embodiment (not shown), if the sealing member (such as the FIG. 5A or FIG. 5B embodiments described above) has a slightly larger circumference than the subject's head at about the hairline level, the sealing member can be provided with tightening strings or analogous structures which are cinched together to reduce the circumference of the sealing member around the subject's head.

While even other embodiments of the sealing member are possible, comfort to the subject is an important factor in the configuration of the sealing member. An elastic headband embodiment as shown in FIG. 5B has been found to be especially comfortable for the subject. A possible reason is that a headband can maintain an effective liquid seal, with minimal pressure per unit area, against the subject's head.

In general, the sealing member 36 is attached to the perimeter of the opening 24 using an adhesive, by stitching, by heat-bonding, or by any of a number of other suitable methods, depending mainly upon the types of materials used to construct the sealing member 36 and the front portion 12. For example, if the front portion 12 is made from flexible plastic sheeting, a sealing member 36 made from a plastic material can be heat-bonded to the plastic sheeting around the perimeter of the opening 24. In any event, it is preferable that the sealing member 36 be attached to the front portion 12 in a way that allows no liquids to pass therebetween.

A rinse shield according to the present invention is preferably able to fit on differently sized heads, thereby permitting a hair stylist to maintain a supply of at most only a few sizes of shields rather than many sizes. As described hereinabove, the sealing member preferably has some degree of elasticity to ensure sealing engagement with the circumference of the wearer's head at about the hairline level. However, unless the material comprising the front portion is also elastic, stretching an elastic sealing member affixed thereto will either be impossible or may cause damage to the front portion.

Figure 6:
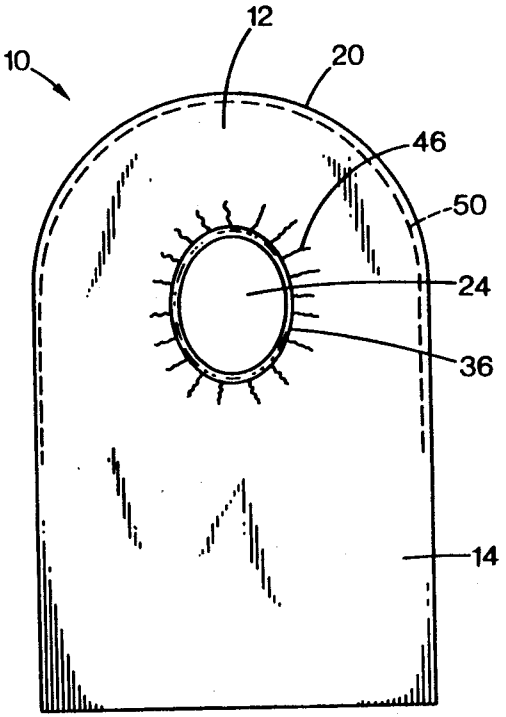
FIG. 6 is a plan view of a rinse shield including rugosities in the front portion for allowing the sealing member to be increased in circumference without damaging the front portion.

To solve this problem, the front portion 12 is preferably provided with a means for allowing the sealing member 36 to stretch, particularly without causing any leaks in the bond between the front portion and the sealing member. In one embodiment shown in FIG. 6, puckers 46, rugosities, or accordion pleats are incorporated into the front-portion at least part way around the opening 24 as the front-portion material is sealingly affixed to the sealing member 36. The puckers 46 enable the front-portion 12 to yield, without tearing or rupturing, to radial stresses imparted by increasing the diameter of the sealing member 36.

Other possible means incorporated into the front portion for accommodating stretch of the sealing member include overlapping flaps and the like (not shown) that can be adjusted relative to each other and fastened together. The flaps can be fastened together by any of a number of disconnectable fastening devices known in the art, such as hook-and-loop fabrics (e.g. VELCRO), snaps, and hooks. A disadvantage of overlapping flaps, however, is their tendency to leak. As a result, overlapping-flap embodiments should include a feature for preventing leaks, such as a flap, for covering the overlap (not shown).

If both the front and tail portions 12, 14 of the rinse shield are made of a drapable sheetlike material, such as a thin plastic membrane, the rinse shield 10 should include a stiffener member 50 attached to the front portion 12 so as to form the front portion into a taut brim around the subject's head when the rinse shield is worn. It is normally not necessary to incorporate a stiffener member into the tail portion. For example, FIG. 2 shows, in outline, an arcuate stiffener member 50 can be placed relative to the margin 20 so as to form a brim.

In one embodiment, as shown in FIGS. 5A and 5B, the stiffener member 50 comprises a wire, thin rod, or analogous longitudinally extended structure (herein referred to as a "wire") affixed at or near the margin 20 of the front portion 12. The wire 50 can be made from any of a variety of springably bendable solid materials such as, but not limited to, corrosion-resistant metals, hard polymeric materials, and glass-plastic composites. The wire 50 is preferably biased to assume a straight configuration but is springably curved, for attachment to the front portion 12, into an arcuate or other shape conforming to the margin 20, as shown for example in FIG. 2. Since the wire 50 always tends to straighten, it continuously urges the margin 20 tautly outward relative to the sealing member 36. As shown in FIG. 2, the wire 50 preferably has sufficient length to extend along the entire margin of the front portion 12.

To guard against tearing the material comprising the front portion 12, the wire 50 is preferably coated or otherwise encased in an elastomeric material. For example, a metal wire can be provided with an outer covering of soft plastic in a manner similar to the insulation on an electrical wire.

The wire 50 as described hereinabove can be affixed at or near the margin 20 by an adhesive, by mechanical fastening means such as loops, hooks, rivets, and the like, by heat-bonding, or other suitable means. In one preferred embodiment as shown in FIGS. 5A and 5B, the wire 50 is inserted into a channel or seam 52 incorporated into the margin 20. Such a channel or seam 52 can be formed by stitching a folded-over portion of the front-portion material along the margin 20, adhesive bonding, or other suitable method.

The wire 50 can also be attached to the front portion 12 in a manner, such as by threading the wire into a seam, or by hooks, loops, and the like, that allows quick removal of the wire 50 from the front portion. In this way, the rinse shield can be conveniently washed in a washing machine.

The stiffener member should have adequate strength to impart sufficient tautness to the brim to enable the brim to remain taut when wet or dry, when the subject's wet hair is placed thereon, and when a water stream such as the stream discharged from a conventional rinsing nozzle impinges thereon.

Figure 7:
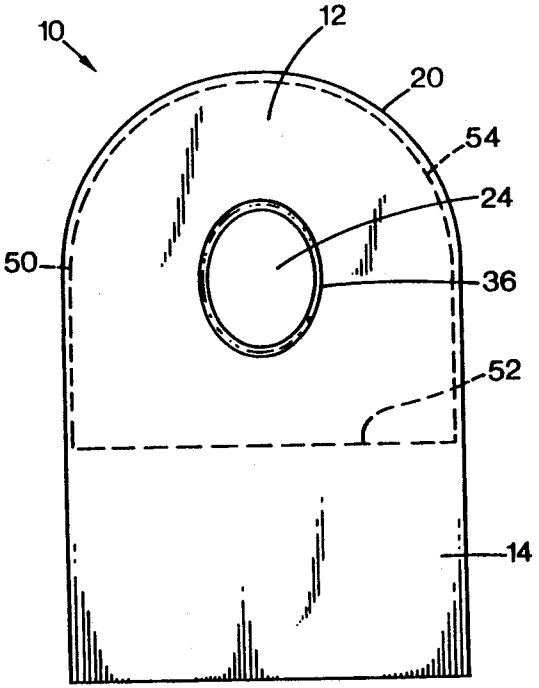
FIG. 7 is a plan view of a rinse shield with a "D"-shaped wire stiffener.

To prevent possible loss of brim tautness behind the subject's head when the rinse shield is worn, it is possible according to the present invention to form a stiffener wire 50 into, for example, a "D" shape, as shown in FIG. 7. The straight portion 52 of the "D," which is contiguous with the arcuate portion 54, extends laterally across the rinse shield 10. Alternatively, instead of the straight portion 52 of the "D"-shaped stiffener 50 being contiguous with the arcuate portion 54, the straight portion 52 can be a separate wire extending laterally across the rinse shield 50. Further alternatively, and for even greater tautness, the "D"-shaped stiffener wire 50 shown in FIG. 7 can include a second straight wire (not shown) extending across the rinse shield 10 adjacent the straight portion 52.

Figure 8:
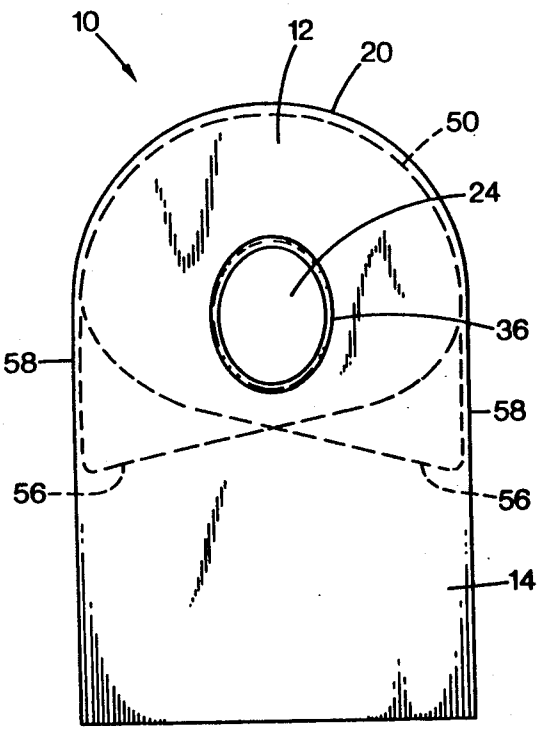
FIG. 8 is a plan view of a rinse shield with an alternatively shaped wire stiffener.

Yet another stiffener shape is shown in FIG. 8 wherein the wire 50 is formed into a loop conforming perimetrically to the front margin 20 of the rinse shield 10, where the ends 56 of the wire cross each other behind the opening 24, continue to the lateral margins 58 of the rinse shield, then follow the lateral margins 58 toward the front margin 20.

It is also possible to fabricate a rinse shield according to the present invention wherein the stiffener is integrally incorporated into the front-portion material (not shown), such as by molding ribs or analogous structures into the front portion out of the same material as the front portion.

Figure 9:
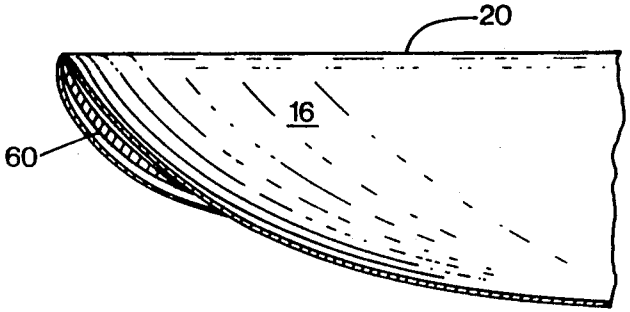
FIG. 9 is a transverse sectional view of a rinse shield as shown in FIG. 2 with an upwardly concave stiffener.

Instead of a "wire" having a substantially circular cross section, the stiffener can have a more complex cross-sectional profile. For example, a preferred embodiment of the rinse shield according to the present invention has an upwardly concave shape, as shown in FIGS. 5A and 5B, whenever the rinse shield is fitted to a subject's head. One way to create such a shape is to incorporate into the brim a stiffener 60 that has an upwardly concave cross-sectional profile, as shown in FIG. 9.

Figure 10:
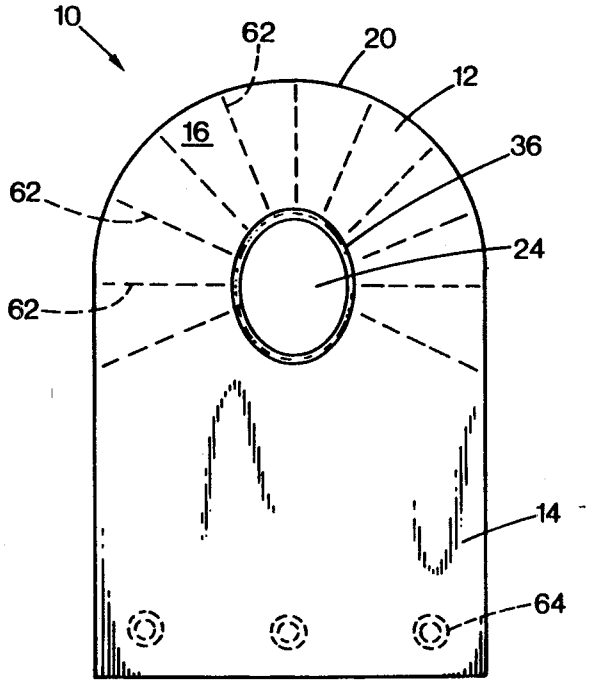
FIG. 10 is a plan view of a rinse shield with radial stiffeners and suction cups.

Yet another way to provide stiffness to the front portion of a rinse shield according to the present invention is incorporate radial stiffeners 62 in the front portion 12, such as wires or the like, as shown in FIG. 10. These radial stiffeners 62 can be longitudinally upwardly curved to facilitate forming an upwardly concave-shaped brim, shown generally in FIGS. 5A and 5B.

Yet another way (not shown) to form the front portion into a brim is to manufacture the front portion using multiple plies of sheetlike material to impart the requisite stiffness thereto. Alternatively, it is also possible to merely fabricate the front portion from a thicker or more rigid sheetlike material than the tail portion.

Figure 12:
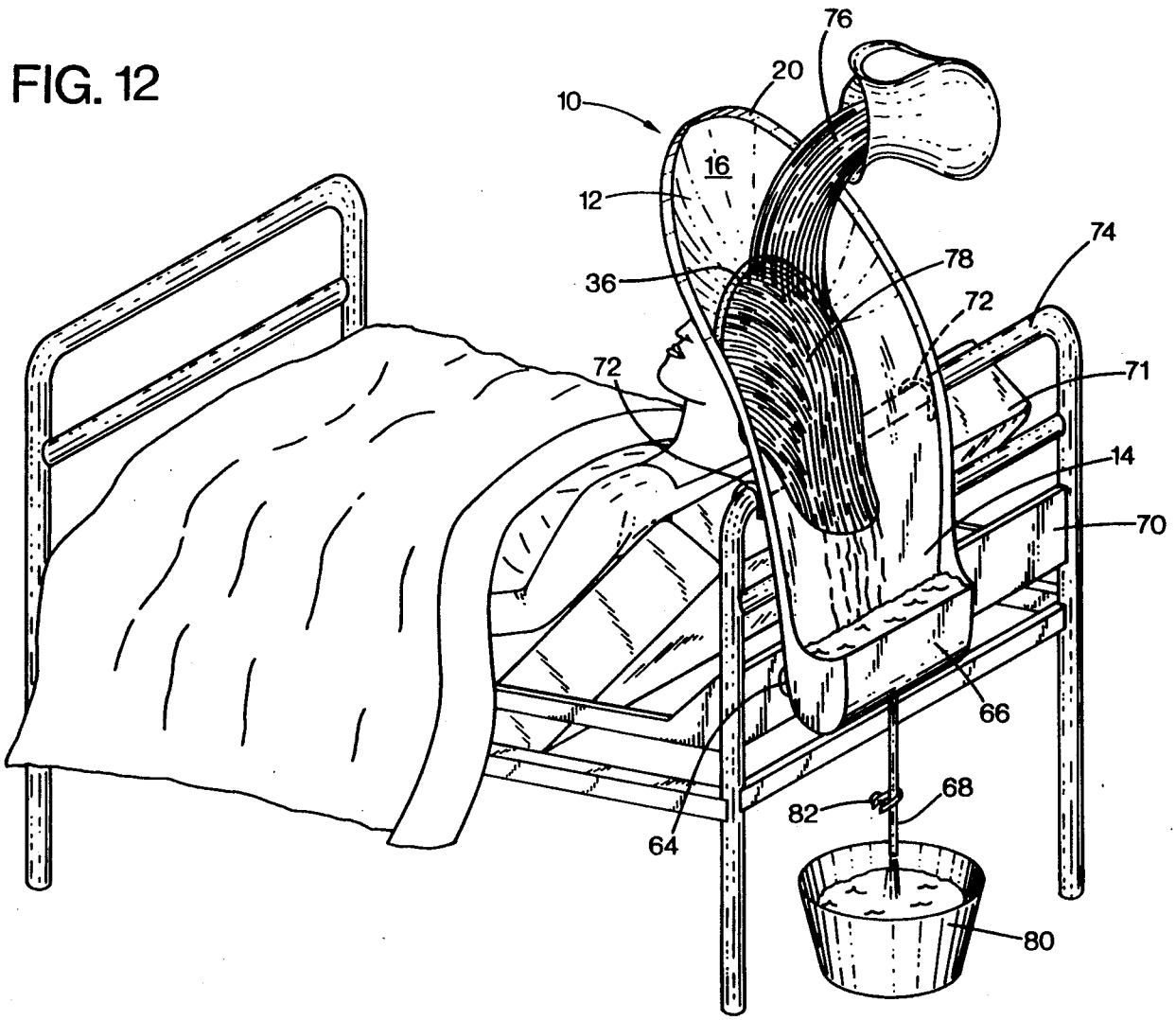
FIG. 12 shows a bedridden person wearing a rinse shield, including features of the rinse shield embodiments of FIGS. 10 and 11, while the person's hair is being rinsed.

Referring further to FIG. 10 and also to FIG. 12, the tail portion 14 can have one or more suction cups 64 or analogous attachment means affixed thereto. It can be readily envisioned that attachment means such as suction cups 64 facilitate temporary adhesion of the tail portion 14 to an object such as the frame 70 of a bed 71 or other person-supporting apparatus. The suction cups 64 can also be used to adhere the tail portion 14 to the interior side wall of a shampoo sink or other vessel during use of the rinse shield (see FIG. 3A). As another example of the attachment means, the tail portion can be provided with hooks 72 or the like (FIG. 12) adapted to engage the rim of a shampoo sink (not shown) or even a bed rail 74 during use of the rinse shield.

Figure 11:
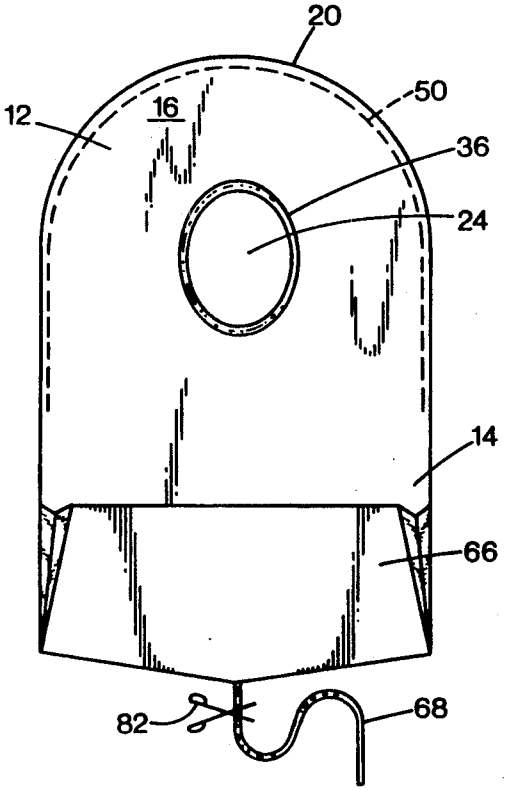
FIG. 11 is a plan view of a rinse shield with a liquid-capturing pouch and drain tube provided on the tail portion.

For use in situations where a sink or vessel is not available or conveniently close at hand, a pouch 66 can be incorporated into the tail portion 14, as shown in FIG. 11. Turning now to FIG. 12, the pouch 66 is adapted for capturing liquids 76 draining from the subject's hair 78 during washing, rinsing, or other treatment involving application of a liquid. A drain tube 68 can also be provided at or near the bottom of the pouch 66 to allow draining of the pouch 66 to a nearby sink or other receptacle 80. If necessary, the drain tube can include a tubing clamp 82 or analogous appliance to allow draining of the pouch to be controlled.

The rinse shield of the present invention can be adapted for either single use (disposable) or multiple use. Alternatively, the stiffener can be reusable and the remainder of the rinse shield can be single-use, where the stiffener is readily removable from the front portion. Obviously, if the rinse shield or any part thereof is intended for multiple use, it should be cleanable.

While the present invention has been described in connection with a number of preferred and alternative embodiments, it will be understood that, it is limited to those embodiments. On the contrary, it is intended to cover all alternatives, modifications, and equivalents as may be included within the spirit and scope of the invention as defined by the appended claims.

I claim:

1. A rinse shield wearable by a person while the person's hair is being shampooed, rinsed, and the like, the rinse shield comprising:

a sheetlike taut portion having an upper major surface, a lower major surface, and a front margin, the taut portion defining an opening therethrough adapted to sealingly fit on a person's head at about a hairline level with the front margin oriented forwardly and the upper major surface oriented upwardly relative to the person's head with the person's hair placed above the hairline level so as to form the taut portion into a brim around the person's head while preventing liquid applied to the person's hair from passing from the upper major surface to the lower major surface, the brim adapted to inhibit propagation of drips and splashes from above the brim to below the brim;

a flexible sheetlike tail portion contiguous with the taut portion opposite the front margin, the tail portion adapted to drape relative to the taut portion rearwardly relative to the person's head and conduct liquid from the upper major surface of the taut portion to a receptacle for capturing the liquid drained by the tail portion; and attachment means fastened to the tail portion, said attachment means adapted for coupling the tail portion to the receptacle.

2. A rinse shield as recited in claim 1 wherein the upper major surface of the taut portion is upwardly concave.

3. A rinse shield comprising:

a liquid-impermeable flexible sheet member having an upper major surface, a lower major surface, a front portion, a tail portion contiguous with the front portion, and a front-portion margin, the front portion defining an opening therethrough having a circumference dimensioned to fit on a wearer's head at about a hairline level with the tail portion of the sheet member oriented rearwardly relative to the wearer's head, a sealing member affixed circumferentially to the opening and adapted, when the rinse shield is fitted to the wearer's head and the wearer's hair is placed above the hairline level on the upper major surface, to circumferentially contact the wearer's head at about the hairline level and prevent liquid applied to the wearer's hair from passing through the opening between the sealing member and the wearer's head;

a stiffener affixed to the front portion and adapted to tautly draw the front-portion margin radially outward relative to the opening, thereby forming the front portion into a taut brim while allowing the rear portion of the sheet member to drape freely relative to the brim so as to drain liquid away from the upper major surface of the front portion; and attachment means fastened to the tail portion, said attachment means adapted for coupling the tail portion to a receptacle for capturing liquid drained by the tail portion.

4. A rinse shield as recited in claim 3 wherein the upper major surface of the front portion is upwardly concave.

5. A rinse shield as recited in claim 3 wherein the front-portion margin has an arcuate shape and the stiffener comprises a spring wire flexed into the arcuate shape but retaining the propensity to linearly straighten, the spring wire having a length affixed to the front margin.

6. A rinse shield as recited in claim 5 wherein the spring wire is sewn into the front-portion margin.

7. A rinse shield as recited in claim 5 wherein the arcuate spring wire has a first end and a second end and the stiffener further comprises a rigid member extending transversely across the sheet member from the first end of the arcuate spring wire to the second end of the arcuate spring wire.

8. A rinse shield as recited in claim 3 wherein the sealing member comprises a length of elastomeric tubing coupled end-to-end into a toroid.

9. A rinse shield as recited in claim 3 wherein the sealing member comprises a length of elastomeric ribbon coupled end-to-end to form a headband.

10. A rinse shield as recited in claim 3 wherein the sheet member is a plastic film.

11. A rinse shield as recited in claim 3 wherein the tail portion has a length sufficient to at least drape over and cover the wearer's neck whenever the rinse shield is fitted to the wearer's head.

12. A rinse shield comprising:

a liquid-impermeable flexible sheet member having an upper major surface, a lower major surface, a front portion, a tail portion contiguous with the front portion, and a front-portion margin, the front portion defining an opening therethrough having a circumference dimensioned to fit on a wearer's head at about a hairline level with the tail portion of the sheet member oriented rearwardly relative to the wearer's head, the tail portion including at least one suction cup for temporarily affixing the tail portion to an object;

a sealing member affixed circumferentially to the opening and adapted, when the rinse shield is fitted to the wearer's head and the wearer's hair is placed above the hairline level on the upper major surface, to circumferentially contact the wearer's head at about the hairline level and prevent liquid applied to the wearer's hair from passing through the opening between the sealing member and the wearer's head; and a stiffener affixed to the front portion and adapted to tautly draw the front-portion margin radially outward relative to the opening, thereby forming the front portion into a taut brim while allowing the rear portion of the sheet member to drape freely relative to the brim so as to drain liquid away from the upper major surface of the front portion.

13. A rinse shield comprising:

a flexible, liquid-impermeable, plastic sheet member having an upper major surface, a lower major surface, a front portion, a rear portion contiguous with the front portion, and a front-portion margin, the front portion having a middle defining an opening therethrough, the opening having a circumference dimensioned to fit on a wearer's head at about a hairline level with the rear portion of the sheet member oriented rearwardly relative to the wearer's head, a sealing member affixed circumferentially to the opening and adapted, when the rinse shield is fitted to the wearer's head and the wearer's hair is placed above the hairline level on the upper major surface, to circumferentially contact the wearer's head at about the hairline level and prevent liquid applied to the wearer's hair from passing between the sealing member and the wearer's head;

a stiffener affixed to the front-portion margin and adapted to pull the front-portion margin radially outward relative to the sealing member, thereby forming the front portion into a taut brim having an upwardly concave upper major surface while allowing the rear portion of the sheet member to drape freely relative to the brim so as to drain liquid away from the upper major surface of the front portion; and attachment means fastened to the tail portion, said attachment means adapted for coupling the tail portion to a receptacle for capturing liquid drained by the tail portion.

14. A rinse shield wearable by a person, while the person is resting on a person-supporting apparatus, whenever the person's hair is being shampooed, rinsed, and the like, the rinse shield comprising:

a sheetlike taut portion having an upper major surface, a lower major surface, and a front margin, the taut portion defining an opening therethrough adapted to sealingly fit on a person's head at about a hairline level with the front margin oriented forwardly and the upper major surface oriented upwardly relative to the person's head while the person's hair placed above the hairline level on the upper major surface so as to form the taut portion into a brim around the person's head while preventing liquid applied to the person's hair from passing through the opening from the upper major surface to the lower major surface, the brim adapted to inhibit propagation of drips and splashes from above the brim to below the brim;

a flexible sheetlike tail portion contiguous with the taut portion opposite the front margin, the tail portion adapted to drape relative to the taut portion rearwardly relative to the person's head and conduct liquid away from the upper major surface of the taut portion;

a pocket situated on the tail portion for capturing a mass of liquid conducted from the taut portion by the tail portion; and attachment means fastened to the tail portion, said attachment means adapted for coupling the tail portion to the person-supporting apparatus so as to support the mass of liquid captured in the pocket.

15. A rinse shield as recited in claim 14 further comprising a drain line coupled to the pocket to allow liquid captured in the pocket to be drained from the pocket.

16. A rinse shield as recited in claim 14 wherein the apparatus adapted to support the person comprises a bed with a bed rail and said attachment means comprises means for coupling the tail portion to the bed rail.

17. A rinse shield as recited in claim 16 wherein said attachment means comprises hooks adapted for engaging the bed rail.

18. A rinse shield as recited in claim 14 wherein said attachment means further comprises at least one suction cup.

* * * * *

UNITED STATES PATENT AND TRADEMARK OFFICE

CERTIFICATE OF CORRECTION

PATENT NO. : 5,146,629

DATED : September 15, 1992

INVENTOR(S) : Monica L. Barnes

It is certified that error appears in the above-indentified patent and that said Letters Patent is hereby corrected as shown below:

On the title page: Item [56] Reference Cited, U.S. Patent Documents

| Number | Date | Name | Class | Subclass |
|---|---|---|---|---|
| 4,428,079 | 01/31/84 | McKee | 4 | 174 |
| 3,241,155 | 03/22/66 | Phillips | 2 | 9 |
| 3,038,470 | 06/12/62 | Campbell | 128 | 146 |
| 2,432,767 | 12/16/47 | Klein | 2 | 174 |

Column 5, line 28, "ca" should read --can--.

Signed and Sealed this

Twenty-sixth Day of October, 1993

*Attest:*

*Attesting Officer*

Bruce Lehman

BRUCE LEHMAN

*Commissioner of Patents and Trademarks*